US006945812B2

(12) United States Patent
Sawayanagi

(10) Patent No.: US 6,945,812 B2
(45) Date of Patent: Sep. 20, 2005

(54) BRACKET

(75) Inventor: Masahiro Sawayanagi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/670,419

(22) Filed: Sep. 26, 2003

(65) Prior Publication Data

US 2004/0092157 A1 May 13, 2004

(30) Foreign Application Priority Data

Sep. 30, 2002 (JP) ..... P 2002-287387

(51) Int. Cl.[7] ..... H01R 12/24
(52) U.S. Cl. ..... 439/495
(58) Field of Search ..... 439/399, 400, 439/404, 495, 496, 76.2, 949

(56) References Cited

U.S. PATENT DOCUMENTS 4,537,455 A * 8/1985 Vertenten et al. ..... 439/404
4,641,904 A * 2/1987 Kosugi et al. ..... 439/497
4,978,314 A * 12/1990 Maejima ..... 439/398
4,997,388 A * 3/1991 Dale et al. ..... 439/404
5,041,007 A * 8/1991 Liu et al. ..... 439/404
5,122,079 A * 6/1992 Locati ..... 439/417
5,944,553 A * 8/1999 Yasui et al. ..... 439/495

FOREIGN PATENT DOCUMENTS

JP 2002-124340 4/2002

* cited by examiner

*Primary Examiner*—Briggitte R. Hammond
(74) *Attorney, Agent, or Firm*—Finnegan, Henderson, Farabow, Garrett & Dunner, L.L.P.

(57) ABSTRACT

A bracket includes a female connector housing, bus bar circuits, pressure welding edges, and a lower cable support rib. The female connector housing has a cable wiring surface on which a plurality of cables are wired. The bus bar circuits are disposed on the cable wiring surface in an exposed state. The pressure welding edges are formed on the bus bar circuits to connect the cables to the bus bar circuits by pressure welding. The lower cable support rib is disposed on the cable wiring surface for supporting the cables not to be contacted to the bus bar circuits except the pressure welding edges.

5 Claims, 11 Drawing Sheets

BRACKET

CROSS REFERENCE TO RELATED APPLICATION

This application claims benefit of priority under 35 U.S.C. § 119 to Japanese Patent Application No. 2002-287387, filed on Sep. 30, 2002, the entire contents of which are incorporated by reference herein.

BACKGROUND OF THE INVENTION

1. Field of the Invention

The present invention relates to a bracket, which is used for fixing an accessory installed in a vehicle, such as a sun visor, to a panel.

2. Description of the Related Art

A bracket is used when an accessory such as a sun visor installed in a vehicle is fixed to a panel. A certain kind of bracket has a connector additionally disposed for supplying electric current to a night lamp of the sun visor. The connector is electrically connected to a flat cable wired on the vehicle side.

For such a bracket as to be applied to electric connection, the bracket disclosed in JP 2002-124340 A is conventionally known. As shown in FIG. 1 and FIG. 2, a connector 100 includes a connector housing 101 with a cable wiring surface 101*a* on its top surface and a cover 102 covering the cable wiring surface 101*a* of the connector housing 101. A number of pressure welding edges 103 are disposed upright at intervals on the cable wiring surface 101*a* of the connector housing 101. Male terminals (not shown in the figures) connected to the pressure welding edges 103 are disposed in terminal receptacles (not shown in the figures) of the connector housing 101.

A procedure of pressure welding operation in pressure welding a flat cable 105 electrically to the connector 100 is as follows. First, a midway portion of the flat cable 105 is placed above the pressure welding edges 103 and then the cover 102 is disposed over the flat cable 105. Next, pressing the cover 102 toward the connector housing 101, the flat cable 105 pushed by the cover 102 cuts into the pressure welding edges 103 to connect each conductor 105*a* of the flat cable 105 to the pressure welding edges 103 by pressure welding. Finally, the procedure of the pressure welding operation is completed by means of mounting the cover 102 on the connector housing 101.

Using the connector 100, each conductor 105*a* of the flat cable 105 is connected at a touch to the pressure welding edges 103 by pressure welding, through placing the flat cable 105 on and the cover 102 over the cable wiring surface 101*a* and then pressing the cover 102.

Since the pressure welding edges 103 are connected electrically to the male terminals, the pressure welding edges 103 and the male terminals can be integrated in one body with the bus bar circuits. Therefore, the number of components of the connector can be reduced and also the ease of setting up the connector is enhanced.

However, since the pressure welding edges 103 are integrally formed as a part of every bus bar circuit, the bus bar circuits are disposed on the cable wiring surface 101*a* of the connector housing 101 in an exposed state. Therefore, each conductor 105*a* is wired so as to pass above each cite of the bus bar circuit except the pressure welding edge. In the case above, since a coated portion of each conductor 105*a* can touch directly the bus bar circuit, an accidental short circuit between the conductor 105*a* and the bus bar circuit is liable to occur when the coated portion of the flat cable 105 is damaged.

SUMMARY OF THE INVENTION

The object of the present invention is to provide such a bracket that may prevent an accidental short circuit between a cable and a bus bar circuit resulting from damage to a coated portion of the cable due to contacting with the bus bar circuit.

In order to accomplish the above object, the present invention provides a bracket comprising a connector housing having a cable wiring surface onto which a cable are wired, a bus bar circuit disposed in an exposed state on the cable wiring surface, a pressure welding edge formed on the bus bar circuit for connecting the cable to the bus bar circuit by pressure welding, and a lower cable support rib disposed on the cable wiring surface for supporting the cable not to be contacted to the bus bar circuit except the pressure welding edge.

According to the present invention, since downward displacement of the cable is restrained with the lower cable support rib, an accidental short circuit between a conductor of the cable and the bus bar circuit resulting from damage to a coated portion of the cable due to contacting with the bus bar circuit disposed thereunder can be prevented. Further, since vibration of the cable due to external vibration is also restrained with the lower cable support rib, increase in electrical resistance between the conductor and the pressure welding edge can be prevented.

In a preferred embodiment of the present invention, the lower cable support rib is disposed in the vicinity of the bus bar circuit.

According to the embodiment, since downward displacement of the cables is effectively restrained in the upper space over the bus bar circuits, possibility of damage to a coated portion of the cable due to contacting with the bus bar circuit thereunder can be effectively reduced.

In another preferred embodiment of the present invention, the lower cable support rib is configured so as to be higher than the top surface of the bus bar circuit and lower than the bottom surface of the cable pressure-welded to the pressure welding edges.

According to the embodiment, since the lower cable support rib does not interfere at the time of pressure welding the cable to the pressure welding edge, displacement of the cable toward the bus bar circuit can be prevented.

In another preferred embodiment of the present invention, the bracket further comprising a cover disposed on the connector housing for covering the cable wiring surface, and an upper cable support rib disposed on the internal surface of the cover and configured to be high enough to abut the top surface of the cable in the state where the cover is mounted on the connector housing.

According to the embodiment, vibration of the cable due to external vibration is restrained with the upper cable support rib.

In another preferred embodiment of the present invention, the bracket further comprising first cable-end support portions disposed on both ends of the connector housing, and second cable-end support portions disposed on both ends of the cover for supporting the cable to be disposed approximately parallel with the cable wiring surface above the bus bar circuits, in cooperation with the first cable-end support portions.

According to the embodiment, since both ends of the cable passing above the bus bar circuit are supported by the first and second cable-end support portions, direct contact of the cable with the bus bar circuit can be surely restrained. Therefore, an accidental short circuit between the conductor and the bus bar circuit resulting from damage to a coated portion of the cable due to contacting with the bus bar circuit thereunder can be surely prevented.

DESCRIPTION OF THE PREFERRED EMBOFDIMENTS

In the following, an embodiment of the present invention is described on the basis of the drawings.

The present embodiment is such that the present invention is applied to an on-vehicle bracket for fixing a sun visor (an accessory) disposed on the upper end of a windshield in front of the driver's seat or the front seat of an automobile to a panel.

Figure 1:
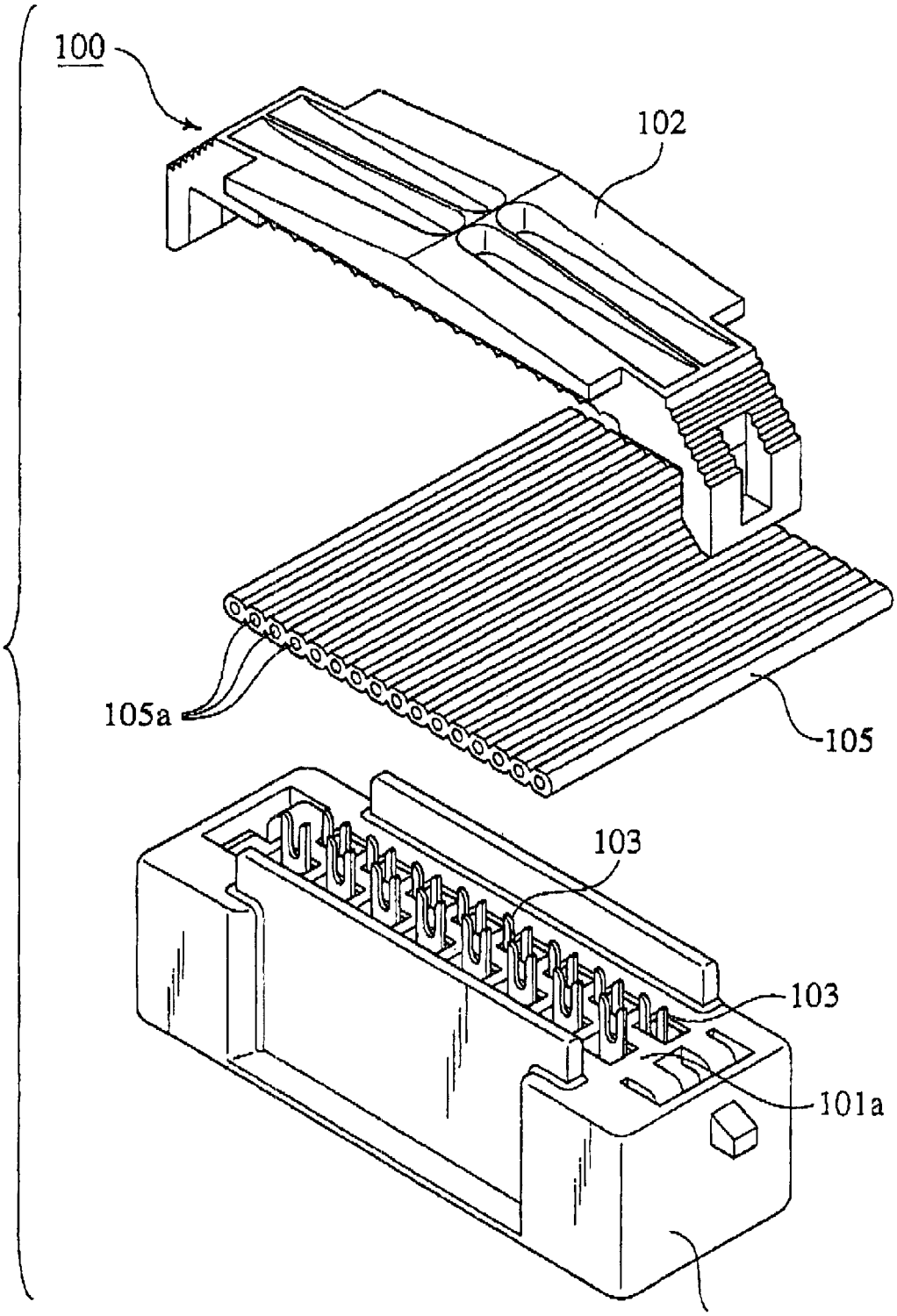
FIG.1 PRIOR ART
FIG. 1, showing an example according to a prior art, is a perspective view of a connector before assembly.
Figure 2:
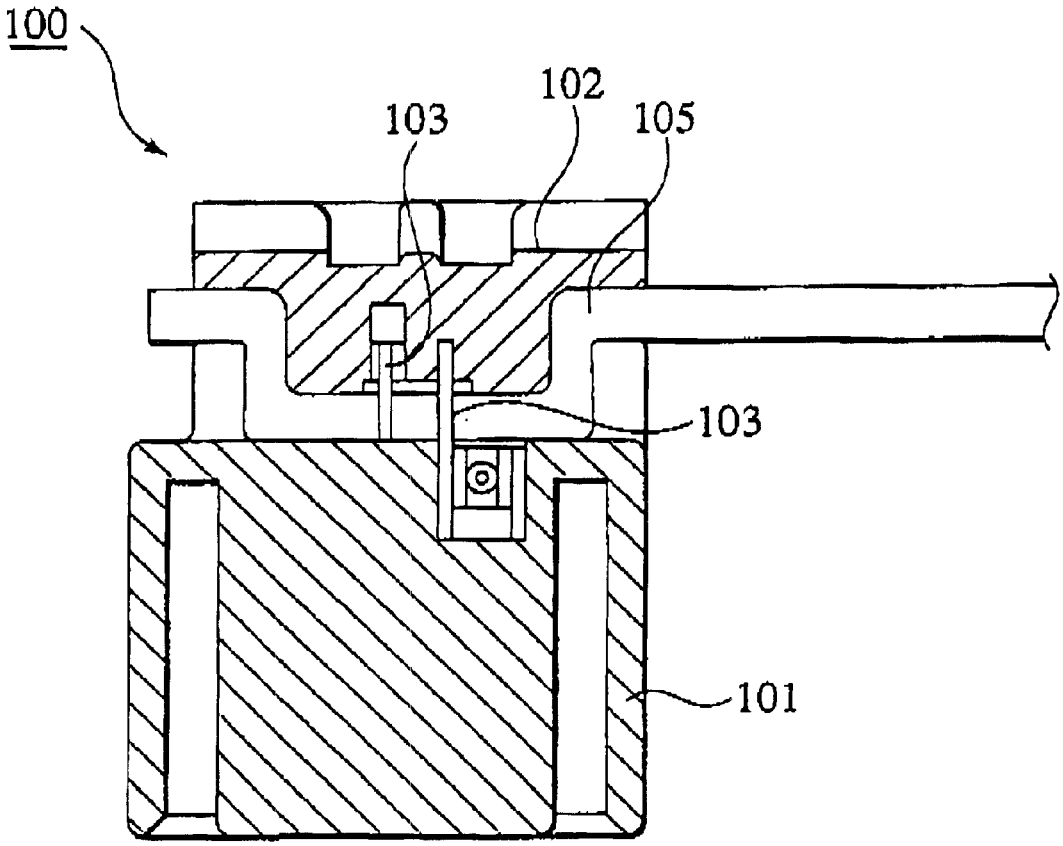
FIG.2 PRIOR ART
FIG. 2, showing an example according to a prior art, is a longitudinal cross section of a connector after assembly.
Figure 3:
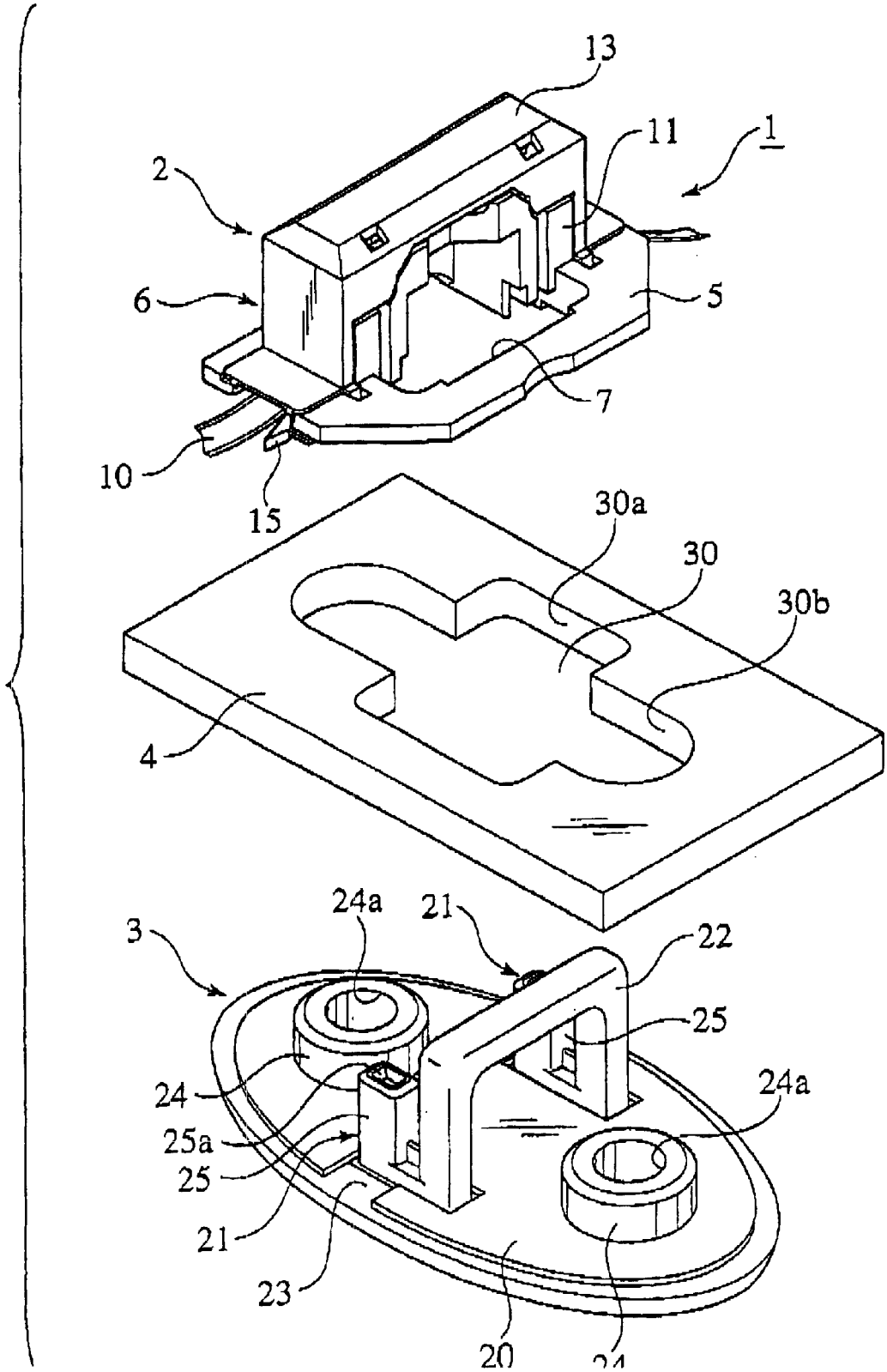
FIG. 3, showing an embodiment of the present invention, is an exploded perspective view of an on-vehicle bracket.
Figure 4:
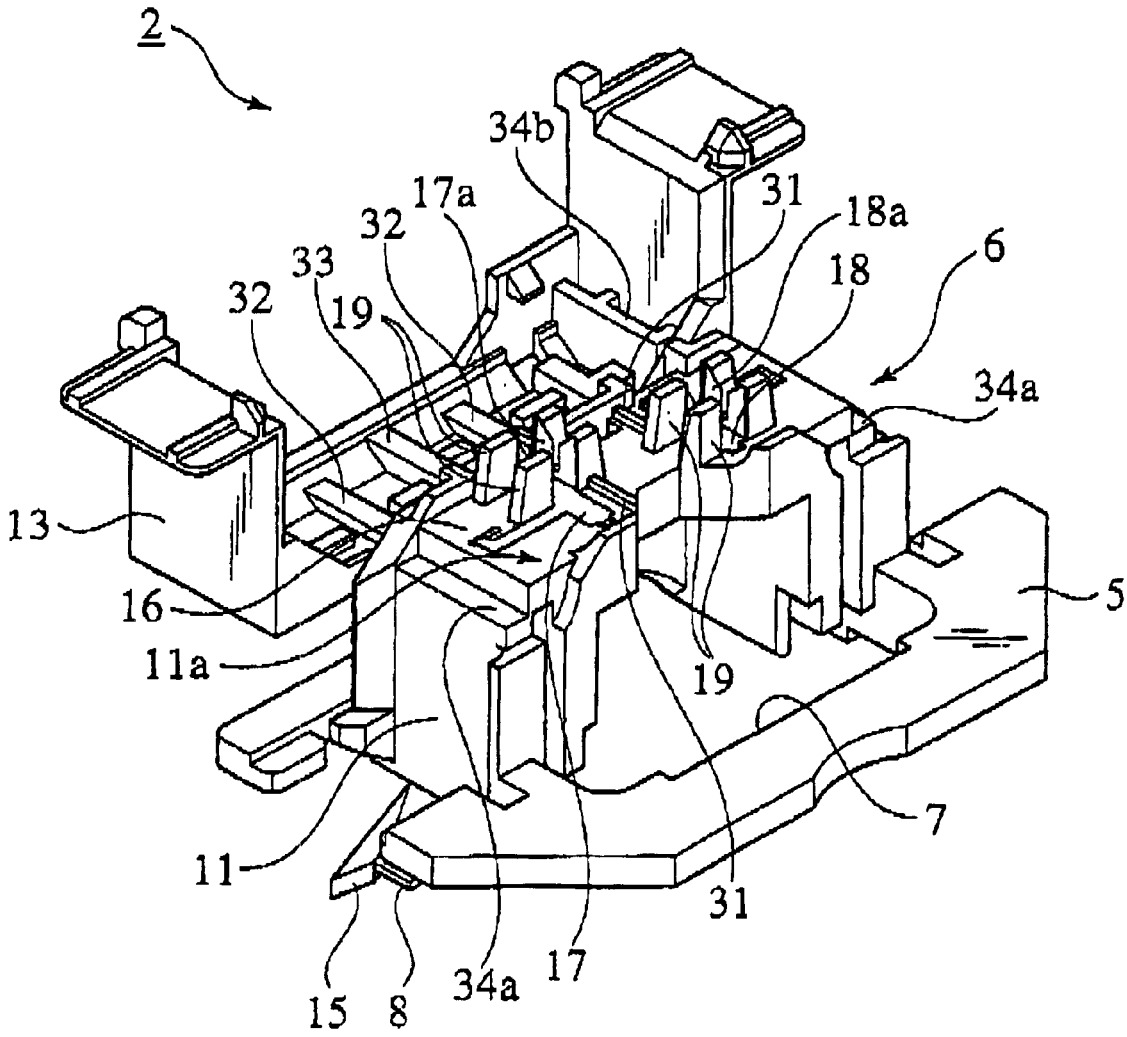
FIG. 4, showing an embodiment of the present invention, is a perspective view of a panel-side bracket in the state before a cover is fixed to a female connector housing.
Figure 5:
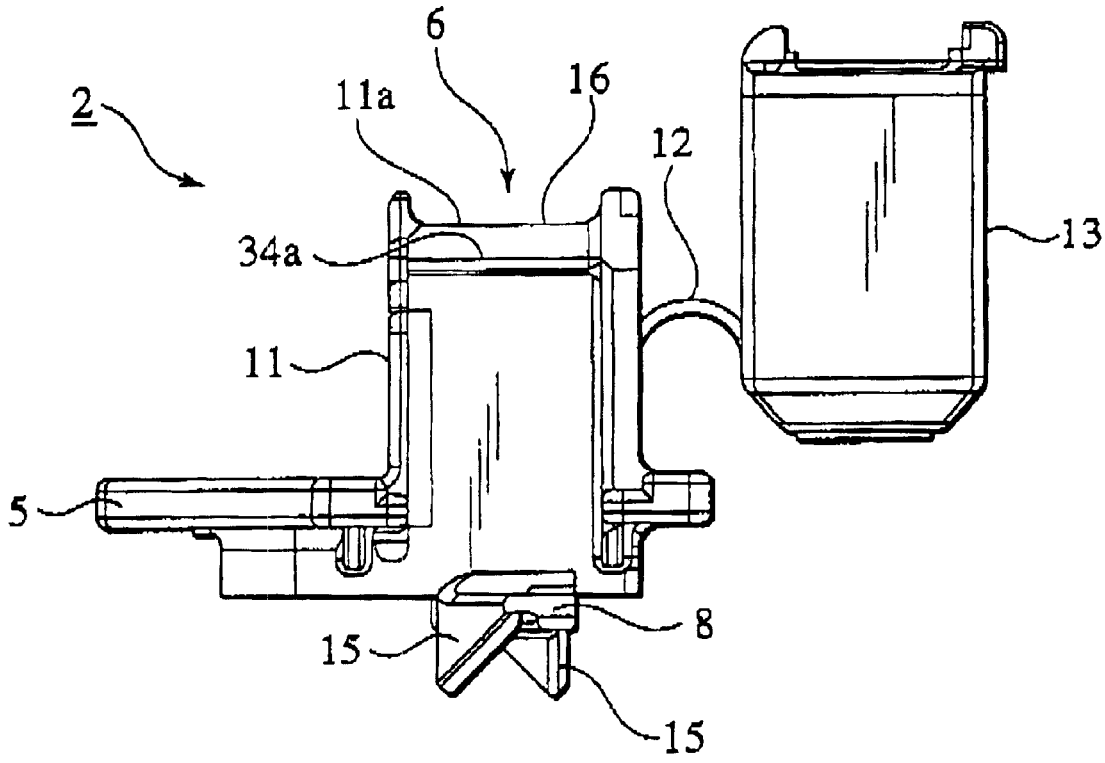
FIG. 5, showing an embodiment of the present invention, is a front view of a panel-side bracket in the state before a cover is fixed to a female connector housing.

As shown in FIG. 3, the on-vehicle bracket 1 has a panel-side bracket 2, a visor side bracket 3 and a trim 4. The panel-side bracket 2 (the bracket) is fixed to the trim 4, which is an upholstery component of the panel. The visor-side bracket 3 is combined with the panel-side bracket 2 and also supports the sun visor (not shown in the figure).

As shown in FIG. 4 to FIG. 11, the panel-side bracket 2 has a base plate 5, a panel-side connector portion 6, a location/engagement portion 7 and a couple of hook portions 8. The panel-side connector portion 6 is disposed prominently on the top surface of the thin planar base plate 5. The location/engagement portion 7 is formed in the center of the base plate 5. A couple of the hook portions 8 are disposed on the bottom surface of the base plate 5 in opposition to each other and are also in the sectional shape of a letter L protruding outward respectively from the axis of rotation O for fixing.

The panel-side connector portion 6 is integrally formed into one body together with the base plate 5 and is composed of a female connector housing 11, a hinge 12, a cover 13 and bus bar circuits 17, 18. The female connector housing (the connector housing) 11 has a cable receiving channel 11*a* for receiving a flat cable 10 along on the top surface and both sides thereof. The cover 13 is connected to the female connector housing 11 via the hinge 12 and holds the flat cable 10 by means of covering the cable receiving channel 11*a* of the female connector housing 11. The bus bar circuits 17, 18 are disposed on a cable wiring surface 16 of the female connector housing 11.

Figure 10:
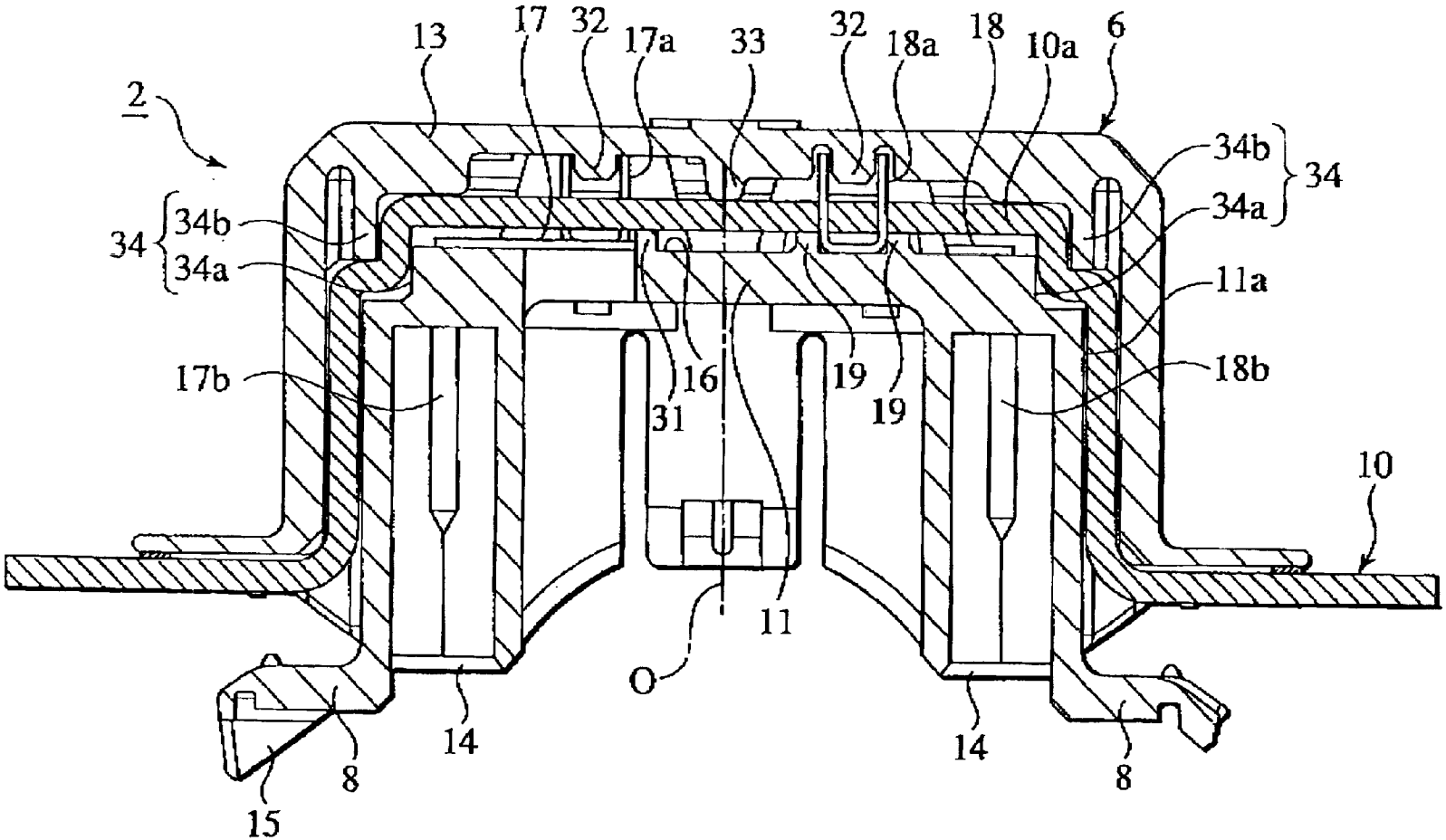
FIG. 10, showing an embodiment of the present invention, is a longitudinal cross section of the panel-side bracket on which a flat cable is wired.
Figure 11:
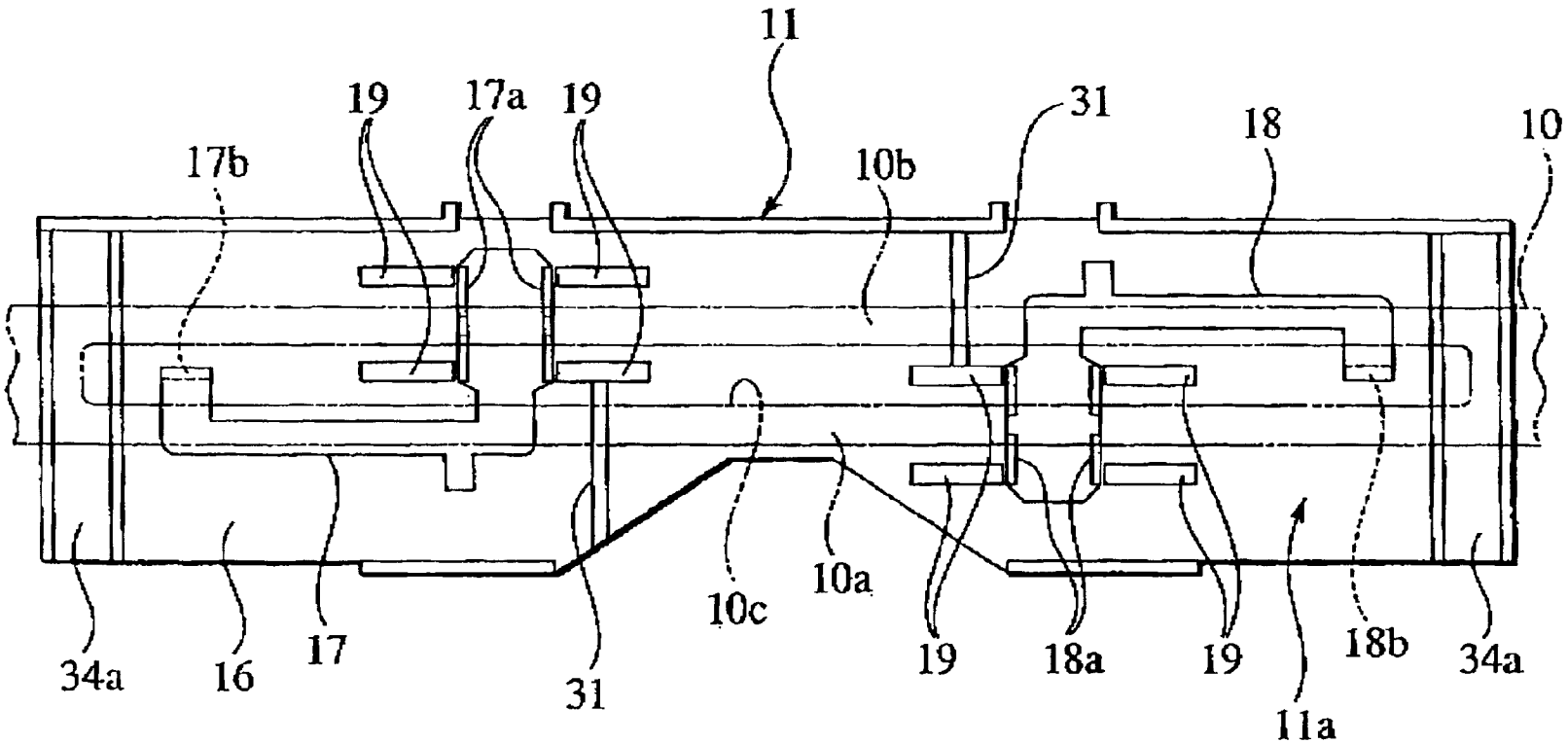
FIG. 11, showing an embodiment of the present invention, is a plan view of the panel-side bracket on which the flat cable is wired.

The female connector housing 11 has a partner-connector insertion opening 14 (refer to FIG. 10) on the bottom surface thereof. As described later, a visor-side connector portion 21 is inserted into the partner-connector insertion opening 14. The bottom surface of the cable receiving channel 11*a* formed on the top surface of female connector housing 11 is the cable wiring surface 16. On the cable wiring surface 16, the bus bar circuits 17, 18 are disposed in an exposed state. As shown in FIGS. 10 and 11, pressure welding edges 17*a*, 18*a* and male terminals 17*b*, 18*b* are integrally formed into the bus bar circuits 17, 18. The pressure welding edges 17*a*, 18*a* protrude from the top surface of the cable wiring surface 16, and are connected to cables 10*a*, 10*b* of the flat cable 10 by pressure welding. The male terminals 17*b*, 18*b* are disposed within the female connector housing 11 and are connected to female terminals (not shown in the figure) of the visor side connector portion 21 as stated later. The cable 10*a*, 10*b* of the flat cable 10, which have been connected to the pressure welding edges 17*a*, 18*a* respectively, are wired so as to pass above each cite of the bus bar circuits except the pressure welding edges 17*a*, 18*a*.

On the cable wiling surface 16 disposed upright at appropriate locations are a plurality of edge support projections 19 for supporting the pressure welding edges 17*a*, 18*a* and also disposed prominently at two sites are lower cable support ribs 31. A plurality of the edge support projections 19 let the pressure welding edges 17*a*, 18*a* stand upright almost perpendicular to the cable wiring surface 16. The two lower cable support ribs 31 are respectively disposed under the cables 10*a*, 10*b* wired on the cable wiring surface 16 and also disposed in the vicinity of the bus bar circuits 17, 18. The lower cable support ribs 31 are respectively configured to be at the level higher than the top surfaces of the bus bar circuits 17,18 and at the same time lower than the bottom surface of the flat cable 10 pressure welded to the pressure welding edges 17*a*, 18*a*.

In the interior of the cover 13, edge restraint projections 32 are disposed at two cites. An upper cable support rib 33 is disposed between the two edge restraint projections 32. The two edge restraint projections 32 make the cables 10*a*, 10*b* cut into the pressure welding edges 17*a*, 18*a* and hold the cables 10*a*, 10*b* not so as to fall off the pressure welding edges 17*a*, 18*a* in the state where the cover 13 is mounted on the female connector housing 11. The upper cable support rib 33 is disposed above the cables 10*a*, 10*b* wired on the cable wiring surface 16 and is configured to be high enough to abut the top surface of the flat cable 10 in the state where the cover 13 is mounted on the female connector housing 11.

Cable-end support means 34, 34 for supporting the flat cable 10 to be disposed approximately parallel to the cable wiring surface 16 above the bus bar circuits 17, 18 are disposed at both ends of the cable wiring surface 16 and the cover 13, respectively, of the female connector housing 11. The cable-end support means 34, 34 are composed of hollow portions 34*a*, 34*a* and pressing projections 34*b*, 34*b*. The hollow portions 34*a*, 34*a* are formed at both ends of the cable wiring surface 16 of the female connector housing 11. The pressing projections 34*b*, 34*b* protrude from the inner surface of the cover 13 and press the flat cable 10 against the interiors of the hollow portions 34*a*, 34*a* to make that part of the flat cable 10 stand upright in the vertical direction. Since the flat cable 10 wired on the cable wiring surface 16 is, as shown in FIG. 10, made to stand upright in the vertical direction at both right and left ends of the cable wiring surface 16 by means of the cable-end support means 34, 34, the flat cable 10 is disposed approximately parallel to the cable wiring surface 16 above the bus bar circuits 17, 18 and along the inner surface of the cover 13.

Figure 6:
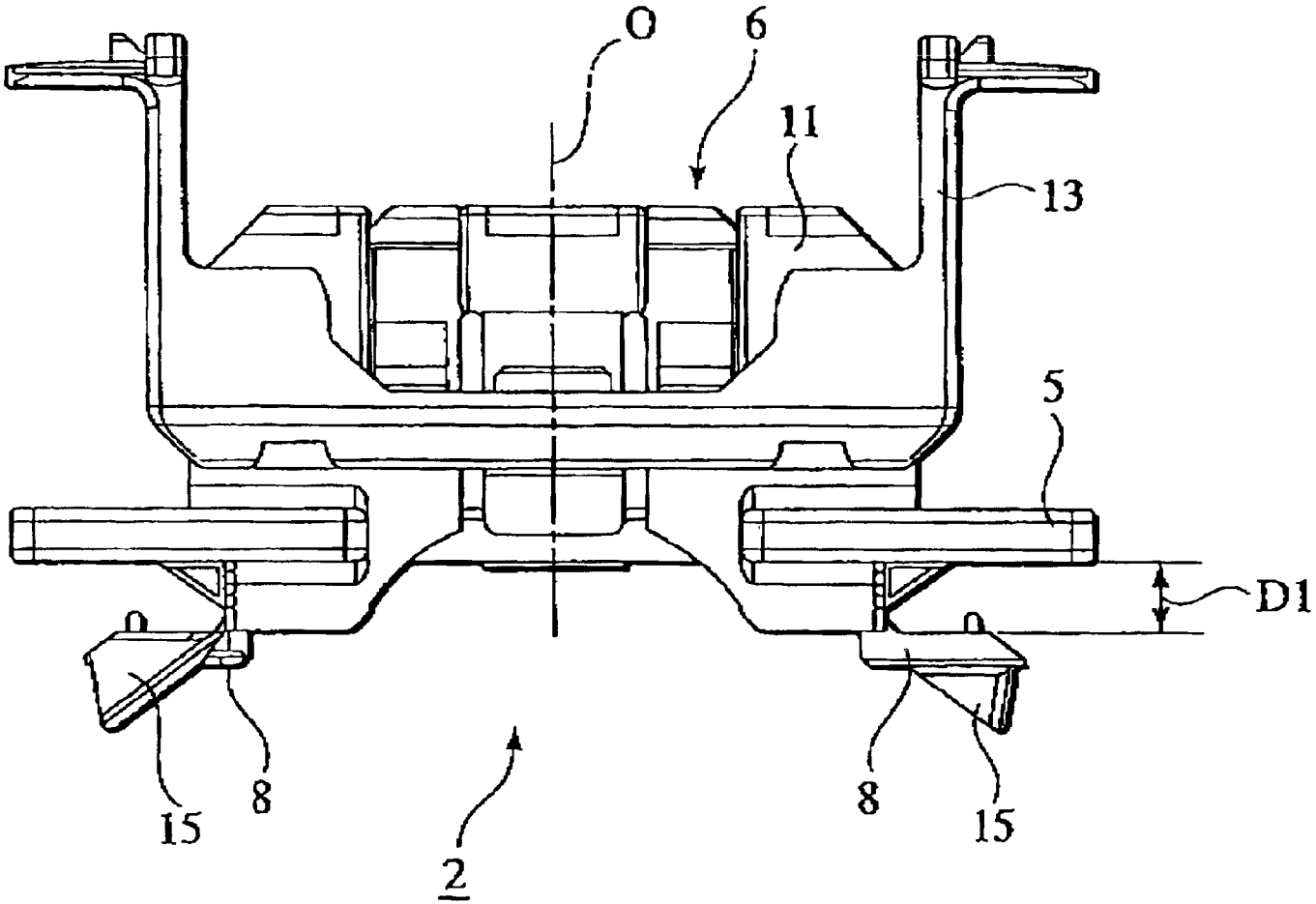
FIG. 6, showing an embodiment of the present invention, is a side view of the panel-side bracket in the state before a cover is fixed to a female connector housing.
Figure 7:
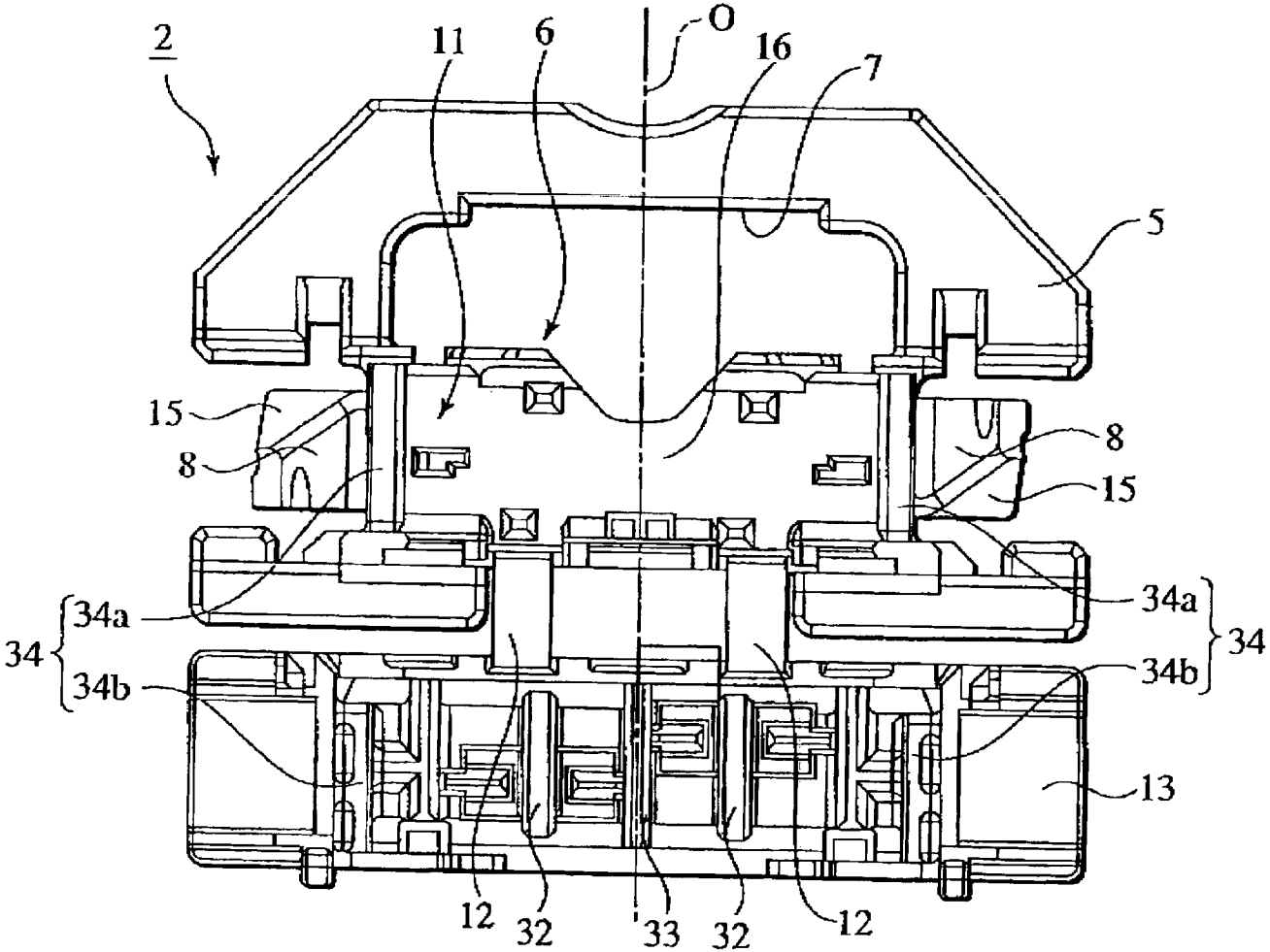
FIG. 7, showing an embodiment of the present invention, is a plan view of the panel-side bracket in the state before a cover is fixed to a female connector housing, and further an edge support projection, an lower cable support rib, etc are not shown in the figure.

As shown in FIG. 6, the distance D1 between the hook portion 8 and the top surface of the base plate 5 is defined to be near the thickness of an ordinary trim 4. At the top end, in the direction of rotation M for fixing (refer to FIG. 8), of each hook portion 8, an elastic vane portion 15 is integrally disposed in the shape of a triangle. A couple of the elastic vane portions 15 are respectively inclined so as to leave the base plate 5 as they go upstream in the direction of rotation M for fixing.

The visor-side bracket 3 has, as shown in FIG. 3, an assembly substrate 20, a couple of visor-side connector portions 21, a guide bar portion 22, a couple of hook receiving recesses 23 and a couple of screw fixing portions 24. The assembly substrate 20 is a thin flat plate approximately in the shape of an ellipse. A couple of the visor-side connector portions 21 are disposed prominently on the top surface of the assembly substrate 20. The guide bar portion 22 is disposed prominently on the top surface of the assembly substrate 20 and is approximately in the shape of a letter C. A couple of the hook receiving recesses 23 are formed on the top surface of the assembly substrate 20 and outside of a couple of the visor-side connector portions 21. A couple of the screw fixing portions 24 are disposed on the top surface of the assembly substrate 20.

The visor-side connector portion 21 is composed of male connector housings 25 and female terminals (not shown in the figure). The male connector housings 25 are fixed to the assembly substrate 20. The female terminal is contained within the male connector housing 25. The male connector housing 25 has a partner-terminal insertion opening 25*a* on the top surface thereof. The male terminals 17*b*, 18*b* of the bus bar circuits 17, 18 are inserted into the partner-terminal insertion openings 25*a*. The end portion of a cable (not shown in the figure) from the sun visor side is connected to the female terminal. The hook receiving recess 23 has large room enough to contain the hook portion 8 and the elastic vane portion 15 and also such a depth as to be able to contain the hook portion 8. The screw fixing portion 24 has a screw inserting hole 24*a* formed in the interior thereof. The screw (not shown in the figure) inserted in the screw inserting hole 24*a* is screwed into a screw hole (not shown in the figure) of the panel (not shown in the figure) through an assembly opening 30 of the trim 4.

The trim 4 is an upholstery component fixed to the interior of the panel forming the body of an automobile and is made of such a material as to deform elastically in the direction of its thickness. The assembly opening 30 is formed in the trim 4. The assembly opening 30 is approximately in the shape of a cross, and is composed of a bracket assembly opening 30*a* in the shape of a rectangle and a couple of screw openings 30*b* approximately in the shape of an arc, which communicate with the bracket assembly opening 30*a*. An opening (not shown in the figure) into which the panel-side connector portion 6 is inserted is formed in the panel opposite the bracket assembly opening 30*a* of the trim 4. Further, a screw hole (not shown in the figure) is formed in the panel opposite the screw openings 30*b* of the trim 4. The flat cable 10 is wired above the top surface of the panel. The flat cable 10 is such that the cables 10*a*, 10*b* are combined in the shape of a tape and is separated into a couple of cables 10*a*, 10*b* by a cut 10*c* as shown in FIG. 11.

Figure 8:
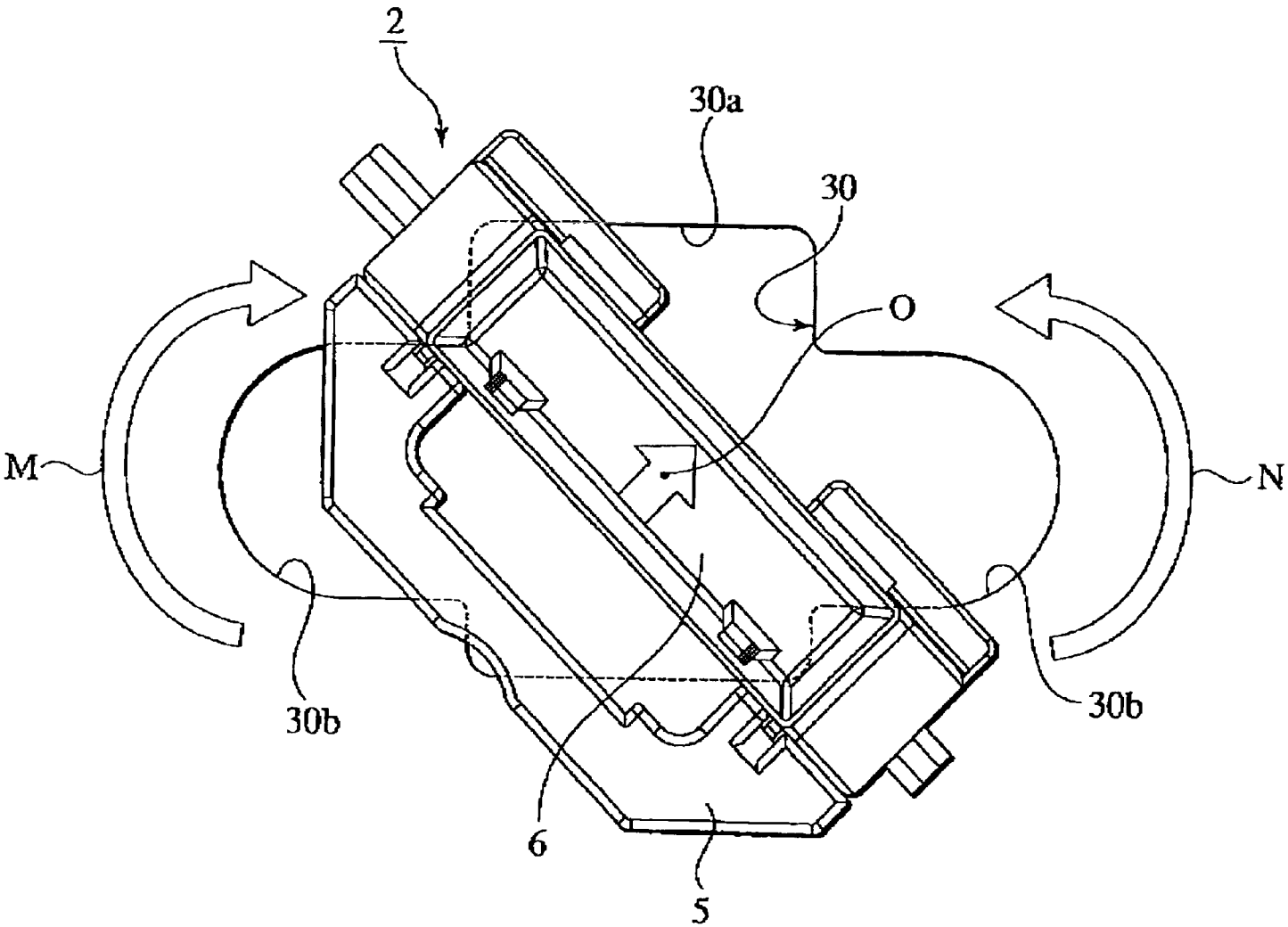
FIG. 8 is a plan view, which shows a procedure in assembling the panel-side bracket into a trim.

The procedure in assembling the on-vehicle bracket 1 is as follows. First, the panel-side bracket 2 is positioned on the top surface (outside the vehicle) of the trim 4 and a couple of the hook portions 8 of the panel-side bracket 2 are inserted into the bracket assembly opening 30*a* of the assembly opening 30 in the trim 4. The panel-side bracket 2 is, as shown in FIG. 8, is inserted along a diagonal of the bracket assembly opening 30*a*, namely via the position at the longest distance from the center of the bracket assembly opening 30*a*.

Next, rotating the panel-side bracket 2 inserted into the assembly opening 30 of the trim 4 in the direction of rotation M for fixing (clockwise in FIG. 8), the periphery of the assembly opening 30 of the trim 4 is slid in between a couple of the hook portions 8 and the base plate 5, because the couple of the hook portions 8 gradually move rotationally toward the position at the short distance from the center of the bracket assembly opening 30*a*. Then, rotating the panel-side bracket 2 so that the couple of the hook portions 8 may slide on the bottom surface of the trim 4 to reach the position where a line joining a couple of the hook portions 8 is perpendicular to the side of the bracket assembly opening 30*a*. At the position where rotation has been completed, the base plate 5 of the panel-side bracket 2 and a couple of the hook portions 8 hold the periphery of the assembly opening 30 of the trim 4 between them to fix the panel-side bracket 2 to the trim 4.

After assembling the panel-side bracket 2 on the top surface of the trim 4, the cut 10*c* is formed in the flat cable 10 by drawing out the flat cable 10 from the opening of the panel to cut off a part of the coated portion of the flat cable 10. Thereby, a part of the flat cable 10 is separated into the two cables 10*a*, 10*b*, Then the cables 10*a*, 10*b* of the flat cable 10 are connected to the pressure welding edges 17*a*, 18*a* of the panel-side connector portion 6 by pressure welding. Finally, the cover 13 is put on the female connector housing 11. Besides, the operation that the cables 10*a*, 10*b* of the flat cable 10 are connected to the pressure welding edges 17*a*, 18*a* of the panel-side connector portion 6 by pressure welding can be performed before assembling the panel-side bracket 2 on the trim 4.

Next, the trim 4 assembled onto the panel-side bracket 2 is fixed to the panel. During this fixing operation, the panel-side connector portion 6 is positioned within the opening of the panel.

Next, the visor-side bracket 3 is integrated with the panel-side bracket 2 by means of inserting the guide bar portion 22 of the visor-side bracket 3 into the location/engagement portion 7 of the panel-side bracket 2 on the bottom surface side of the panel-side bracket 2. The visor-side bracket 3 is guided to the proper bond position with regard to the panel-side bracket 2 according to the guide function of the guide bar portion 22 and the visor-side connector portion 21 of the visor-side bracket 3 is engaged in the proper state with the panel-side connector portion 6 of the panel-side bracket 2.

Figure 9:
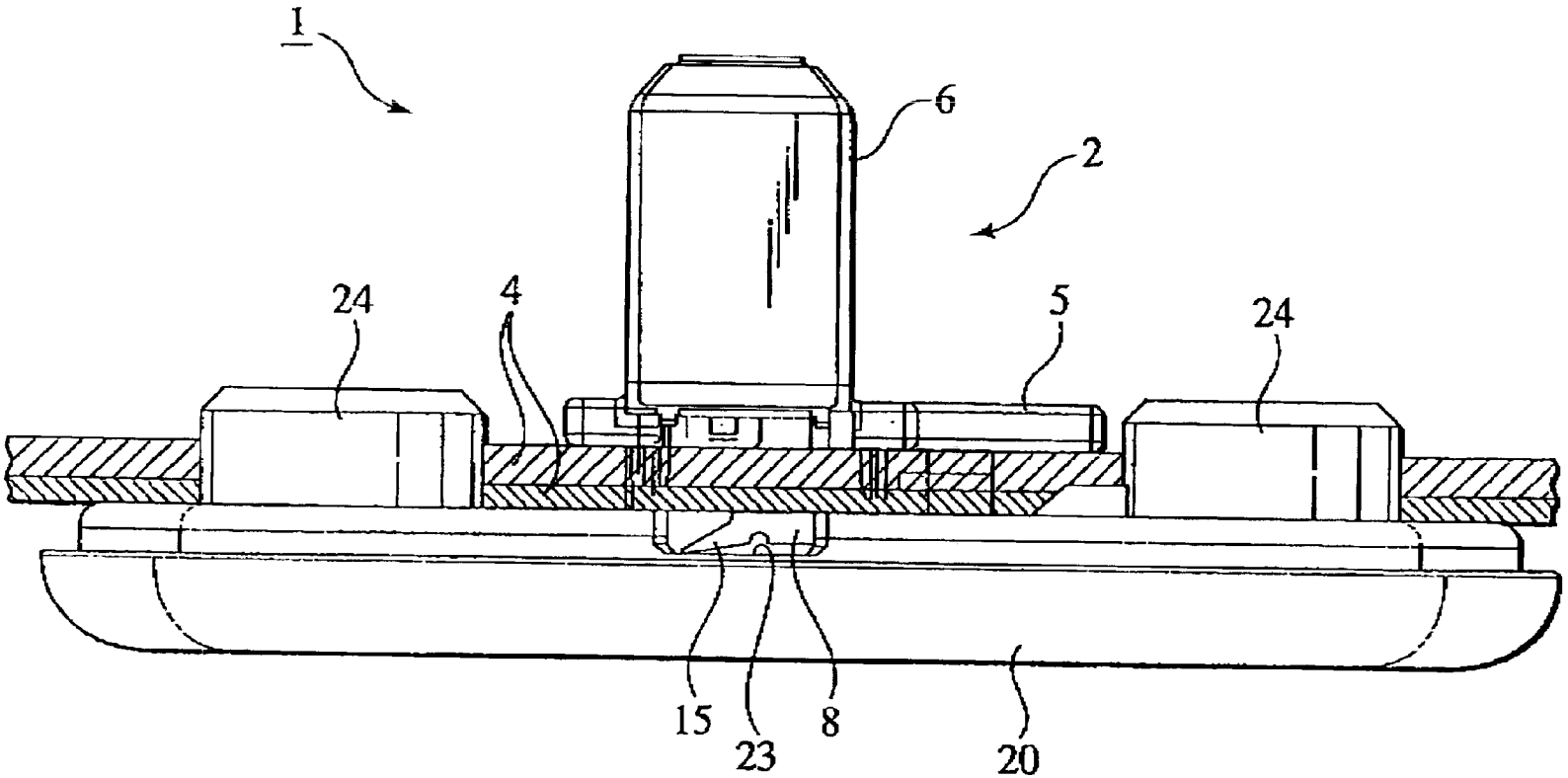
FIG. 9 is a cross sectional view, which shows a state where a visor-side bracket is assembled into the trim into which the panel-side bracket has been assembled.

When the panel-side connector portion 6 and the visor-side connector portion 21 are completely engaged with each other, the panel-side bracket 2 and the visor-side bracket 3 will be locked together temporarily with a temporary locking means (not shown in the figure). Further, when the panel-side connector portion 6 and the visor-side connector portion 21 are completely engaged with each other, the internal female terminals will be electrically connected to the male terminals 17*b*, 18*b* to electrically conductive the flat cable 10 with a cable (not shown in the figure) on the sun visor side. Further, when the visor-side bracket 3 is completely assembled to the panel-side bracket 2, a couple of the hook portions 8 and the elastic vane portions 15 of the panel-side bracket 2 will be contained within a couple of the hook receiving recesses 23 as shown in FIG. 9. Now, since the hook receiving recesses 23 has a depth enough to contain only the hook portion 8, a couple of the elastic vane portions 15 are contained within a couple of the hook receiving recesses 23 of the visor-side bracket 3 in a state where they are elastically deformed by being pressed toward the trim 4.

Next, the assembly of the sun visor (not shown in the figure) is completed by inserting one end of a screw upward from the bottom into the screw fixing portion 24 of the visor-side bracket 3 and by driving the other end of the screw into a screw hole of the panel.

Besides, when disassembly of the on-vehicle bracket 1 is required, the screw will be removed and the visor-side bracket 3 will also be drawn out of the panel-side bracket 2. Then, the panel-side bracket 2 will be removed through the assembly opening 30 of the trim 4 by rotating the panel-side bracket 2 relative to the trim 4 in the direction of rotation for disassembling (counterclockwise in FIG. 6).

As described above, in the panel-side bracket 2, each of the cables 10*a*, 10*b* of the flat cable 10 is wired passing above the one of the bus bar circuits 17, 18 not to be connected by pressure welding. Further, since each of the lower cable support ribs 31 is disposed above the cable wiring surface 16, downward displacement of the flat cable 10 is prevented by the lower cable support ribs 31. Thereby, an accidental short circuit between the cables 10*a*, 10*b* of the flat cable 10 and the bus bar circuits 17, 18 resulting from damage to a coated portion of the flat cable 10 due to contacting with the bus bar circuits 17, 18 located thereunder can be prevented to the utmost. Further, since vibration of the flat cable 10 induced by external vibration, etc. is restrained with the lower cable support rib 31, increase in electrical resistance occurred between the flat cable 10 and the pressure welding edges 17*a*, 18*a* can be prevented. Still further, the strength of the female connector housing 11 is enhanced with the lower cable support ribs 31.

In the present embodiment, since each lower cable support rib 31 is disposed in the vicinity of the bus bar circuits 17, 18, downward displacement of the cables 10*a*, 10*b* of the flat cable 10 located over the bus bar circuits 17, 18 can be effectively restrained. Thereby, possibility of damage to a coated portion of the flat cable 10 due to contacting with the bus bar circuits 17, 18 thereunder is effectively reduced.

In the present embodiment, since the lower cable support rib 31 is configured so as to be higher than the top surfaces of the bus bar circuits 17, 18 and still lower than the bottom surface of the flat cable 10 pressure-welded to the pressure welding edges 17*a*, 18*a*, the lower cable support ribs 31 does not interfere at the time of pressure welding the flat cable 10 to the pressure welding edges 17*a*, 18*a*.

In the present embodiment, since the female connector housing 11 has the cover 13 for covering the cable wiring surface 16 and further the upper cable support rib 33 is disposed on the internal surface of the cover 13 and is configured to be high enough to abut the top surface of the cables 10*a*, 10*b* in the state where the cover 13 is mounted on the female connector housing 11, vibration of the flat cable 10 due to external vibration, etc. is restrained with the upper cable support rib 33 and the lower cable support ribs 31. Therefore, increase in electrical resistance occurred between the flat cable 10 and the pressure welding edges 17*a*, 18*a* can be surely prevented.

In the present embodiment, the cable-end support means 34 are disposed on both ends of the female connector housing 11 and the cover 13 for supporting the flat cable 10 to be disposed nearly parallel to the cable wiring surface 16 above the bus bar circuits 17, 18. Since both ends of the cables 10*a*, 10*b* passing above the bus bar circuits 17, 18 are supported by the cable-end support means 34, direct contact of the cables 10*a*, 10*b* with the bus bar circuits 17, 18 can be surely restrained. Therefore, an accidental short circuit between the cables 10*a*, 10*b* and the bus bar circuits 17, 18 resulting from damage to a coated portion of the cables 10*a*, 10*b* due to contacting with the bus bar circuits 17, 18 located thereunder can be surely prevented.

Besides, although the cable was such a flat cable that two cables 10*a*, 10*b* were combined in the shape of a tape in the present embodiment, the cable can be, not limited by the above description, a single wire or such a flat cable that a plurality of cables are combined in the shape of a tape.

Further, although a couple of the hook portions 8 and the elastic vane portions 15 were disposed opposite to each other in the present embodiment, the number of them can be more than two and then they can be disposed at equal intervals.

Still further, although the bracket according to the present invention was applied to the panel-side bracket 2 of the on-vehicle bracket 1 and the sun visor was fixed to the panel, the bracket of the present invention can be assembled into any other accessories than the sun visor and can also be applied to any other brackets than the on-vehicle bracket 1.

What is claimed is:

1. A bracket comprising:

a connector housing having a cable wiring surface onto which a cable is wired;

a bus bar circuit disposed in an exposed state on the cable wiring surface;

a pressure welding edge formed on the bus bar circuit connecting the cable to the bus bar circuit by pressure welding; and a lower cable support rib disposed on the cable wiring surface supporting the cable such that the cable contacts the pressure welding edge but not the bus bar circuit.

2. The bracket according to claim 1, wherein the lower cable support rib is disposed in a vicinity of the bus bar circuit.

3. The bracket according to claim 1, wherein the lower cable support rib is configured so as to be higher than a top surface of the bus bar circuit and lower than a bottom surface of the cable pressure-welded to the pressure welding edges.

4. The bracket according to claim 1, further comprising:

a cover disposed on the connector housing for covering the cable wiring surface; and an upper cable support rib disposed on an internal surface of the cover and configured to be high enough to abut a top surface of the cable in a state where the cover is mounted on the connector housing.

5. The bracket according to claim 4, further comprising:

first cable-end support portions disposed on both ends of the connector housing; and second cable-end support portions disposed on both ends of the cover supporting the cable to be disposed approximately parallel with the cable wiring surface above the bus bar circuits, in cooperation with the first cable-end support portions.

* * * * *